US005248474A

United States Patent [19]

Morgan

[11] Patent Number: 5,248,474

[45] **Date of Patent: * Sep. 28, 1993**

[54] LARGE THREADED TUNGSTEN METAL PARTS AND METHOD OF MAKING SAME

[75] Inventor: Ricky D. Morgan, Milan, Pa.

[73] Assignee: GTE Products Corporation, Stamford, Conn.

[ * ] Notice: The portion of the term of this patent subsequent to Sep. 16, 2003 has been disclaimed.

[21] Appl. No.: 956,530

[22] Filed: Oct. 5, 1992

[51] Int. Cl.[5] ..... B22F 3/24; C21D 1/00

[52] U.S. Cl. ..... 419/28; 419/29; 419/49; 75/245; 75/248

[58] Field of Search ..... 419/49, 28, 23, 29, 419/38, 48, 49, 53, 54, 57; 75/245, 248

[56] References Cited

U.S. PATENT DOCUMENTS

| | | | |
|---|---|---|---|
| 4,431,605 | 9/1984 | Lueth | 419/49 |
| 4,448,747 | 7/1984 | Moritoki et al. | 419/49 |
| 4,455,278 | 4/1984 | van Nederveen et al. | 419/49 |
| 4,612,162 | 8/1986 | Morgan et al. | 419/49 |
| 5,124,119 | 2/1992 | Grensing | 419/19 |

*Primary Examiner*—Donald P. Walsh
*Assistant Examiner*—Anthony R. Chi
*Attorney, Agent, or Firm*—Elizabeth a. Levy

[57] ABSTRACT

A method of making a threaded tungsten metal part having a diameter or thickness greater than two inches. Tungsten metal powder is hot isostatically pressed and sintered and then machined to the desired thread configuration using a single point tungsten carbide cutting tool.

2 Claims, No Drawings

LARGE THREADED TUNGSTEN METAL PARTS AND METHOD OF MAKING SAME

TECHNICAL FIELD

The invention relates to methods of making threaded tungsten metal parts having a diameter or thickness greater than two inches. Such parts are useful in the manufacture of melting electrodes for high-temperature electric arc furnaces.

BACKGROUND ART

U.S. Pat. No. 4,612,162 to Morgan et al., the teachings of which are hereby incorporated by reference, describes a method of forming high density metal articles by hot isostatic pressing and sintering a metal powder.

Tungsten parts may be made by powder metallurgical techniques. Tungsten-based metal powders may be pressed isostatically and then sintered to achieve a density equivalent to 92%–97% of the theoretical density of the metal. However, tungsten is an extremely hard, brittle material and is thus very difficult to machine. It is susceptible to breaking, chipping and distortion under most machining operations. In particular, it has previously been impossible to fabricate threads in large tungsten parts because of the extreme brittleness of the tungsten material. "Large" parts, as the term is used herein, are those parts having a diameter or thickness greater than two inches.

Pressed and sintered tungsten metal parts may be more easily machined, and even threaded, if they are first mechanically worked to increase the density of the parts. However, mechanical working is only effective on relatively small tungsten parts, that is, on parts having a diameter or thickness less than two inches. Large tungsten parts cannot be uniformly densified through mechanical deformation due to density gradients throughout the part and size and power limitations of the working equipment.

SUMMARY OF THE INVENTION

It is, therefore, an object of the invention to obviate the disadvantages of the prior art.

It is another object of the invention to enhance methods of making large threaded parts out of tungsten.

It is another object of the invention to provide a threaded tungsten metal electrode having a diameter or thickness greater than two inches.

These objects are accomplished, in one aspect of the invention, by a method of making a threaded tungsten metal part having a diameter or thickness greater than two inches. A tungsten metal powder is first pressed and sintered to obtain a first sintered material having a density of between 92 and 97% of the theoretical density of tungsten. The first sintered material is then subjected to a hot isostatic pressing operation to obtain a hot isostatically pressed (HIP) material having a density greater than 99% of the theoretical density of tungsten. The HIP material is then machined to the desired size and thread configuration to obtain a threaded tungsten part having a diameter or thickness greater than two inches.

It will be seen that employing the method of this invention makes it possible to manufacture large threaded tungsten metal parts without breakage, chipping or distortion during manufacture.

BEST MODE FOR CARRYING OUT THE INVENTION

For a better understanding of the present invention, together with other and further objects, advantages and capabilities thereof, reference is made to the following specification and appended claims.

Tungsten metal powders may be hot isostatically pressed according to the method described in U.S. Pat. No. 4,612,162, previously incorporated by reference. The hot isostatic pressing operation results in pressed tungsten parts which have a density of at least 97% of the theoretical density of the tungsten metal. The sintering temperatures may range from 1750° C. to 2100° C., and the sintering times may range from 5 to 72 hours. Suitable hot isostatic pressing conditions are a minimum temperature of 1750° C., a minimum hot isostatic pressing time of at least 1 hour, and a minimum pressure of 20,000 pounds per square inch (psi).

Once the tungsten parts are hot isostatically pressed, the parts may be threaded externally or internally without breakage, chipping or distortion.

The following non-limiting example is presented.

EXAMPLE

Three tungsten billets, 8.250 inches long and 3.750 inches in diameter, were pressed and sintered at 2100° C. for 30 hours to achieve 97% of the theoretical density of tungsten. The parts were then hot isostatically pressed at 1850° C. and 28,000 psi for 2 hours to achieve greater than 99% of the theoretical density of tungsten. The parts were then machined to 8.000 inches long and 3.500 inches in diameter.

Each bar was then machined as follows: a 1.063" diameter hole was drilled into one end of the tungsten bar with a "Valudex" Valenite drill. The bar was then mounted in a Mori Seiki SL 3 CNC machine to be internally threaded with a $1\frac{7}{8}$ diameter by 12 thread per inch thread ($1\frac{7}{8} \times 12$). A 1" boring bar with a Kennametal K313 tungsten carbide single point cutting tool was used. The bar was threaded at a speed of 250 rpm with a maximum starting depth of cut of 0.008". The depth of cut was incrementally decreased at each pass from 0.008" to 0.002" as the cutting tool advanced into the thread, so that as the thread became deeper, less material was removed during each successive pass of the cutting tool. The entire threading operation was completed in 18 to 20 passes. A perchlorethylene coolant was used during the machining and threading operations.

While there have been shown what are at present considered to be the preferred embodiments of the invention, it will be apparent to those skilled in the art that various changes and modifications can be made herein without departing from the scope of the invention as defined by the appended claims.

I claim:

1. A method of making a threaded tungsten metal part having a diameter or thickness greater than two inches, comprising the steps of: providing a tungsten metal powder, pressing and sintering said metal powder to obtain a first sintered material having a density of between 92 and 97% of the theoretical density of tungsten, hot isostatic pressing said first sintered material to obtain a hot isostatically pressed material having a density greater than 99% of the theoretical density of tungsten, machining said hot isostatically pressed material to obtain a tungsten bar having a diameter or thickness greater than two inches, and internally threading said tungsten bar with a single point tungsten carbide cutting tool at a speed of 250 rpm and a maximum starting depth of cut of 0.008 inch, wherein said depth of cut is incrementally decreased during a series of passes from 0.008 inch to 0.002 inch, wherein said machining and said threading steps are performed in the presence of a perchlorethylene coolant, to obtain a threaded tungsten part having a diameter or thickness greater than two inches.

2. A threaded tungsten metal part made by the method of claim 1, wherein said threaded tungsten metal part has a diameter or thickness greater than two inches.

* * * * *